US011998807B2

(12) United States Patent
Neff

(10) Patent No.: US 11,998,807 B2
(45) Date of Patent: Jun. 4, 2024

(54) RACQUET PICK UP SCOOP FOR BALLS

(71) Applicant: Kevin Scott Neff, Eau Claire, WI (US)

(72) Inventor: Kevin Scott Neff, Eau Claire, WI (US)

( * ) Notice: Subject to any disclaimer, the term of this patent is extended or adjusted under 35 U.S.C. 154(b) by 0 days.

(21) Appl. No.: 16/974,380

(22) Filed: Mar. 4, 2020

(65) Prior Publication Data

US 2023/0415002 A1 Dec. 28, 2023

Related U.S. Application Data

(60) Provisional application No. 62/919,381, filed on Mar. 8, 2019.

(51) Int. Cl.
*A63B 47/02* (2006.01)
*A63B 60/00* (2015.01)

(52) U.S. Cl.
CPC ..... *A63B 47/02* (2013.01); *A63B 60/00* (2015.10)

(58) Field of Classification Search
CPC ..... A63B 59/40; A63B 60/00; A63B 47/02
See application file for complete search history.

(56) References Cited

U.S. PATENT DOCUMENTS 5,383,661 A * 1/1995 Beck ..... A63B 47/02 473/517
5,947,850 A * 9/1999 Gray ..... A63B 49/035 473/517
6,066,056 A * 5/2000 Morrow ..... A63B 59/20 473/513
D428,085 S * 7/2000 Kirch ..... D21/722
7,112,153 B1 * 9/2006 Beu ..... A63B 49/02 473/553
D759,907 S * 6/2016 Weinstein ..... D30/160
9,623,304 B2 * 4/2017 Clarke ..... A63B 59/20
9,878,215 B1 * 1/2018 Stanford ..... A63B 47/02
D839,976 S * 2/2019 Legoski ..... D21/722
D997,281 S * 8/2023 Stanford ..... D21/799.1
2008/0261732 A1 * 10/2008 Mullin ..... A63B 47/02 473/517
2010/0087280 A1 * 4/2010 Blades ..... A63B 47/02 473/517
2011/0224032 A1 * 9/2011 Kostouros ..... A63B 47/02 473/517
2013/0165278 A1 * 6/2013 Butterfield ..... A63B 59/20 473/515

* cited by examiner

*Primary Examiner* — Joshua T Kennedy
(74) *Attorney, Agent, or Firm* — Skinner & Associates; Joel Skinner; Jacob Pittman

(57) ABSTRACT

A ball pick-up scoop can be attached to, or molded on, the head end of a tennis racquet. When mounted, formed, or attached the scoop protrudes roughly 80°-90° away from the face side of the racquet. While standing up straight and holding the handle of the racquet, the user slides/pivots the scoop under a ball (tennis, rubber, synthetic, etc.), which cradles the ball between the scoop's ball guides and the racquet's face to facilitate picking up the ball without ever bending over. Once the ball is cradled the user can pivot the racquet up to their opposite hand and grab the ball, or flip the ball up and hit the ball, or let it bounce and then hit the ball.

12 Claims, 20 Drawing Sheets

RACQUET PICK UP SCOOP FOR BALLS

CROSS-REFERENCE TO RELATED APPLICATIONS, IF ANY

This application claims the benefit under 35 U.S.C. § 119(e) of co-pending U.S. Provisional Patent Application Ser. No. 62/919,381, filed Mar. 8, 2019, which is hereby incorporated by reference.

A portion of this disclosure is subject to copyright protection. The copyright holder has no objection to the facsimile reproduction by anyone of the patent document or the patent disclosure, as it appears in the US Patent and Trademark Office patent file or records, but otherwise reserves all other copyright rights.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND

1. Field

The present invention relates, generally, to recreational, exercise, and sporting goods. More particularly, the invention relates to a ball scoop for a racquet. Most particularly, the invention relates to a system, apparatus, and method for a ball scoop that is attachable to, or constructed as part of, a tennis racquet to aid in picking up a tennis ball during a tennis game, or the like. The invention is also suitable for picking up balls that have been thrown to dogs, and the like.

2. Background Information

Existing technology is believed to have significant limitations and shortcomings, thus a need exists for the present invention.

All US patents and patent applications, and all other published documents mentioned anywhere in this application are hereby incorporated by reference in their entirety.

BRIEF SUMMARY

The present invention includes a ball-scoop apparatus and method that is practical, reliable, safe, and efficient, which is believed to fulfill a need and to constitute an improvement over the background technology.

In one aspect, the invention provides a ball scoop adapted to couple to a racquet, the ball scoop comprising:

- a body having: first and second faces, a racquet-engagement member, and a scoop member extending from the racquet-engagement member;
- a pair of angled ball-engagement ridges disposed on the scoop member on the first face; and
- at least one wear ridge disposed on the racquet-engagement member on the second face.

The aspects, features, advantages, benefits, and objects of the invention will become clear to those skilled in the art by reference to the following description, claims, and drawings.

BRIEF DESCRIPTION OF THE DRAWINGS

The present invention, and the manner and process of making and using it, will be better understood by those skilled in the art by reference to the following drawings.

DETAILED DESCRIPTION

Figure 1:
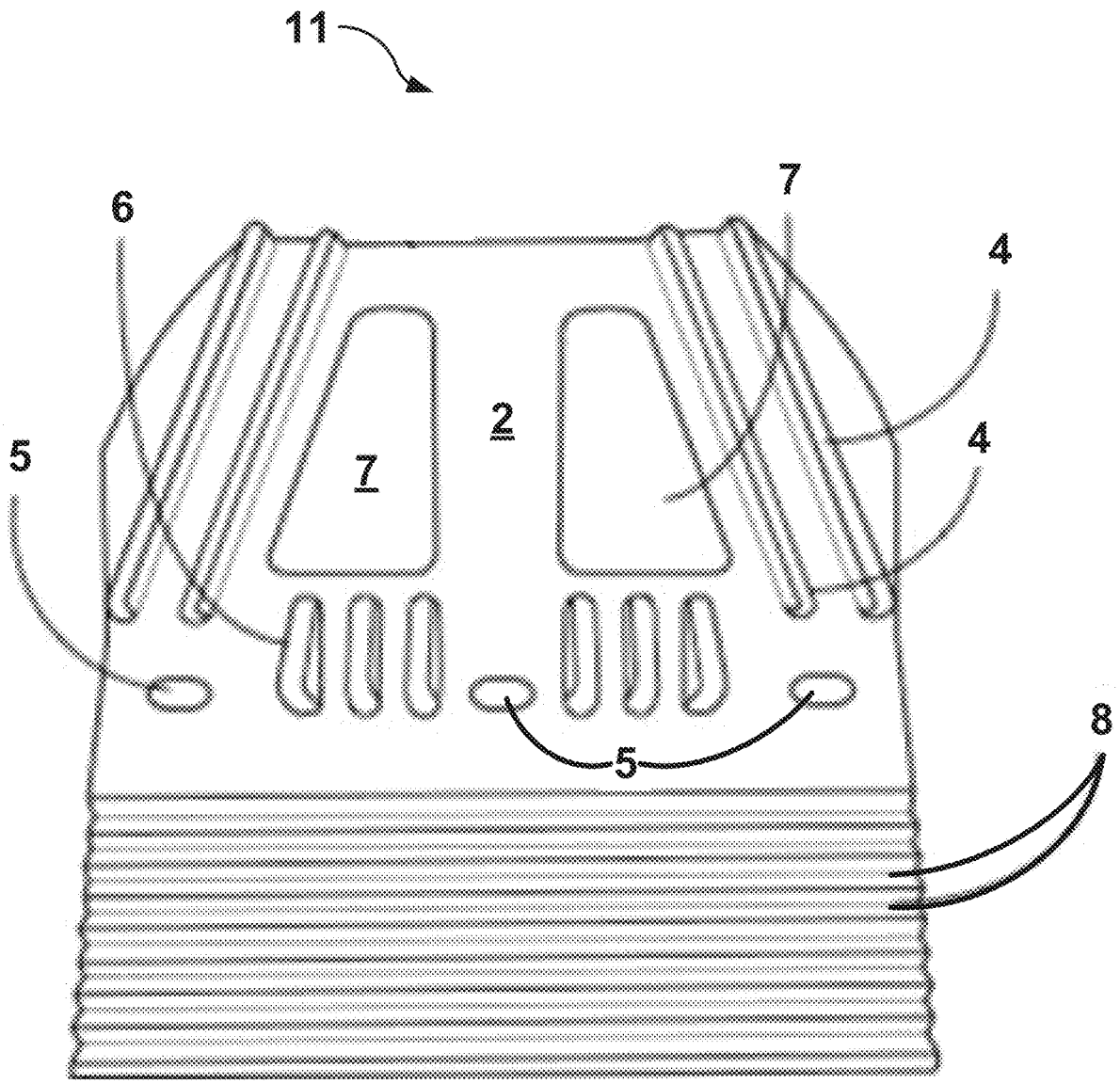
FIG. 1 is a front view of an example ball scoop.
Figure 2:
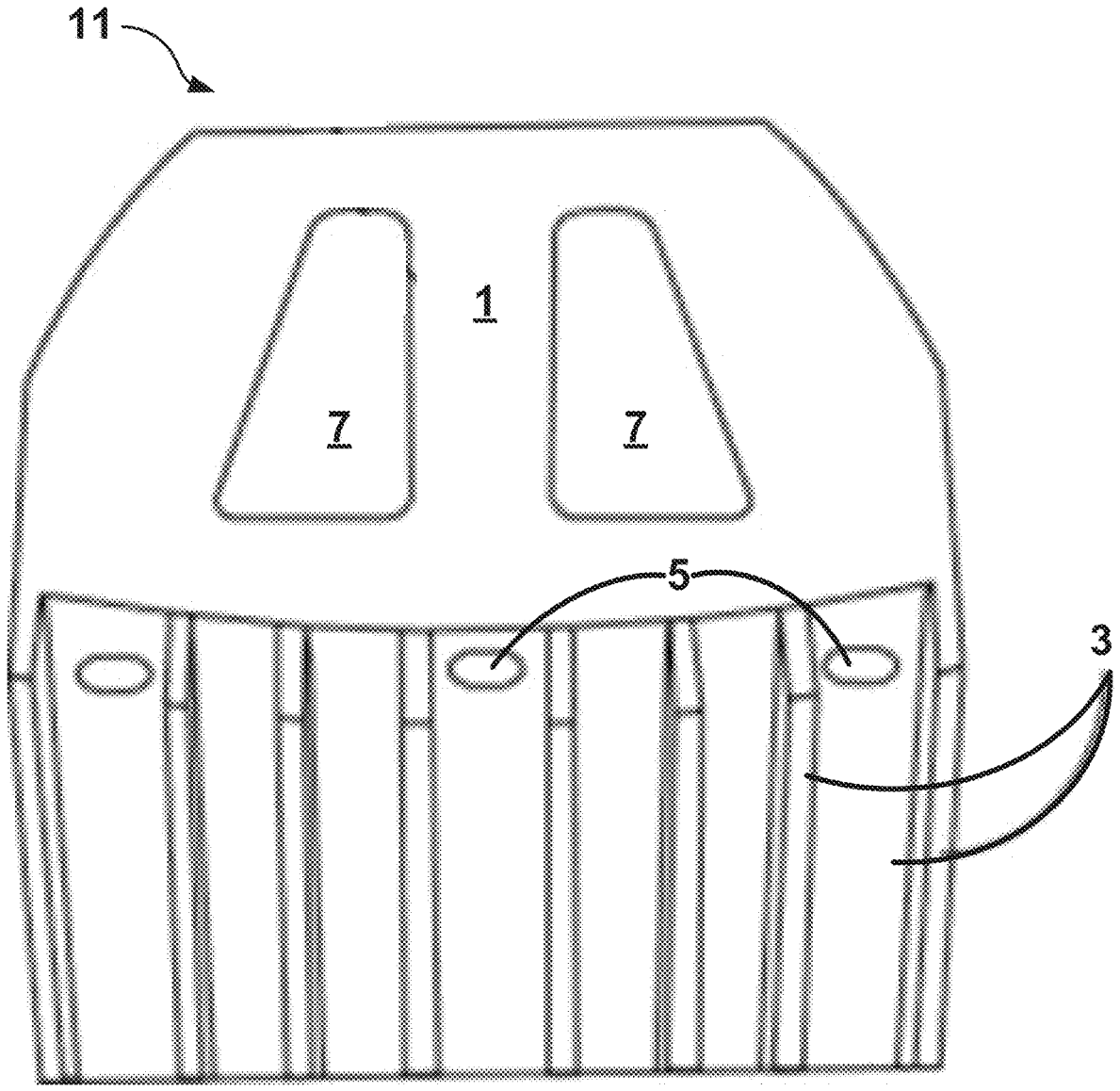
FIG. 2 is a back view of the ball scoop of FIG. 1.
Figure 3:
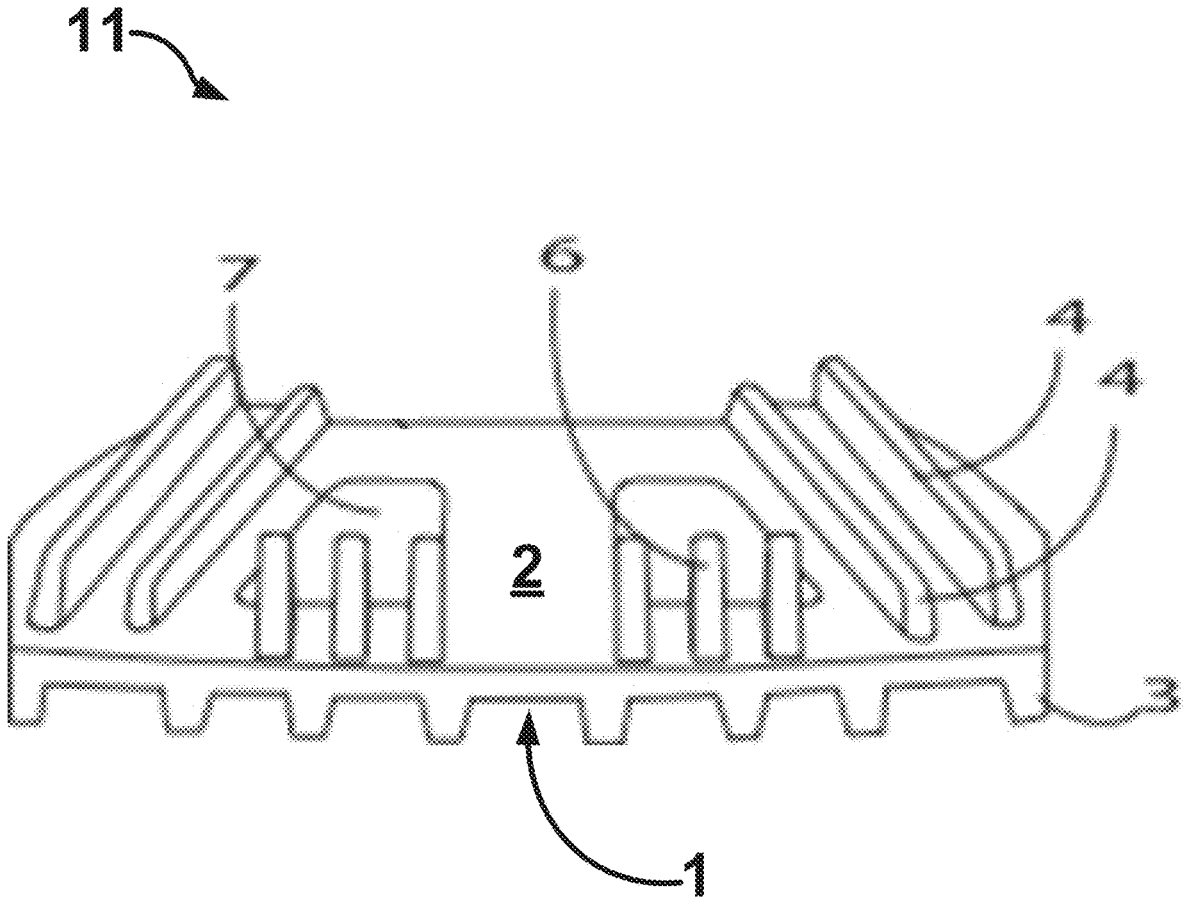
FIG. 3 is a proximal-end view of the ball scoop of FIGS. 1 and 2.
Figure 4:
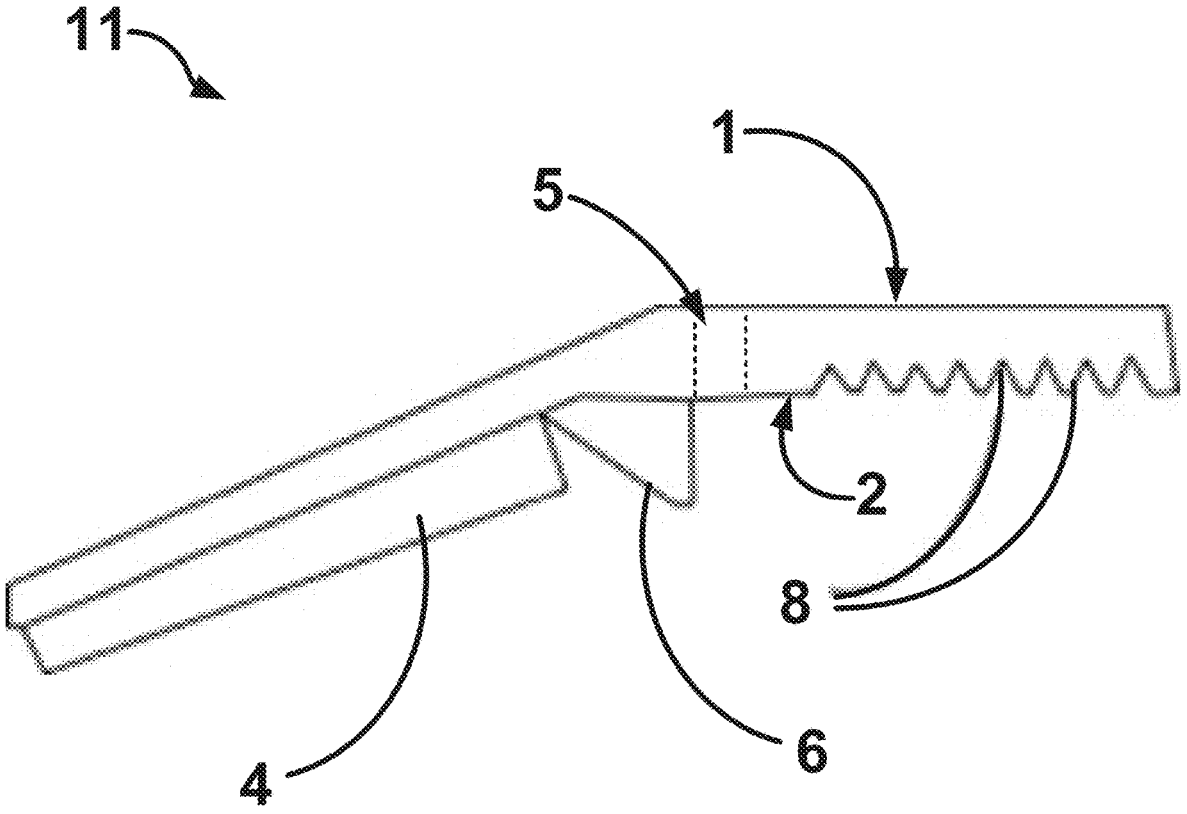
FIG. 4 is a first side view of the ball scoop of FIGS. 1-3.
Figure 5:
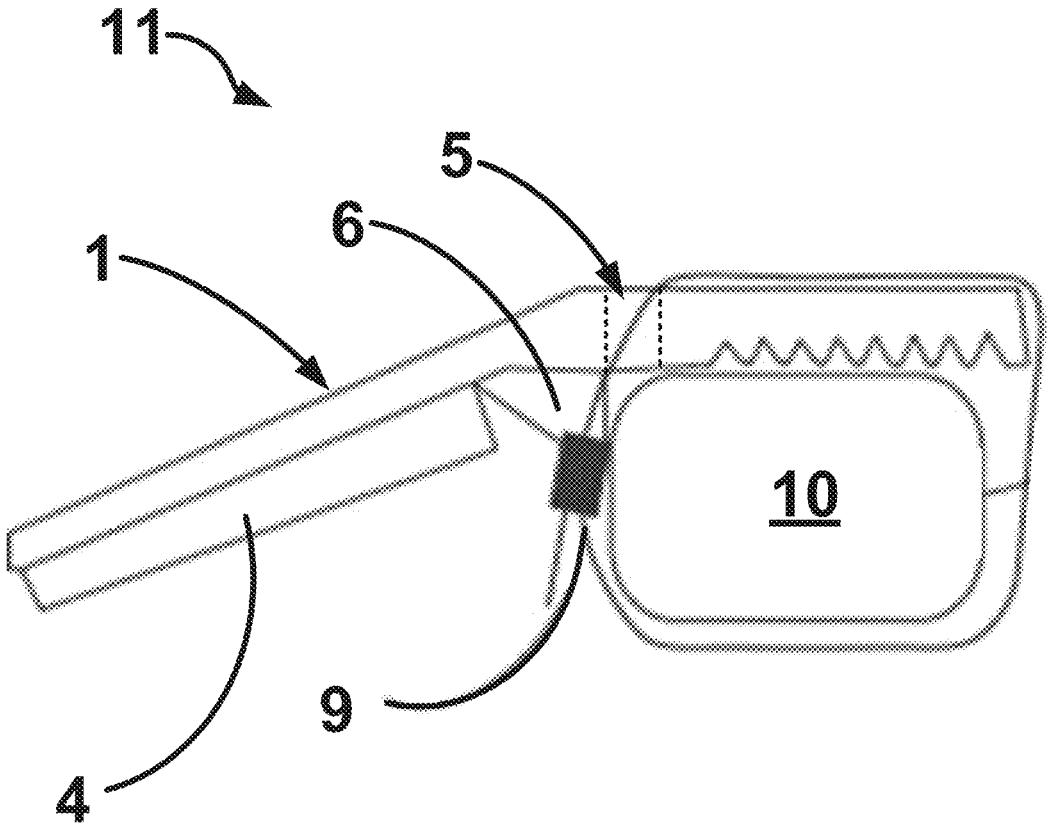
FIG. 5 is another side view of the ball scoop of FIGS. 1-4 attached to a frame of an example racquet or paddle.
Figure 6:
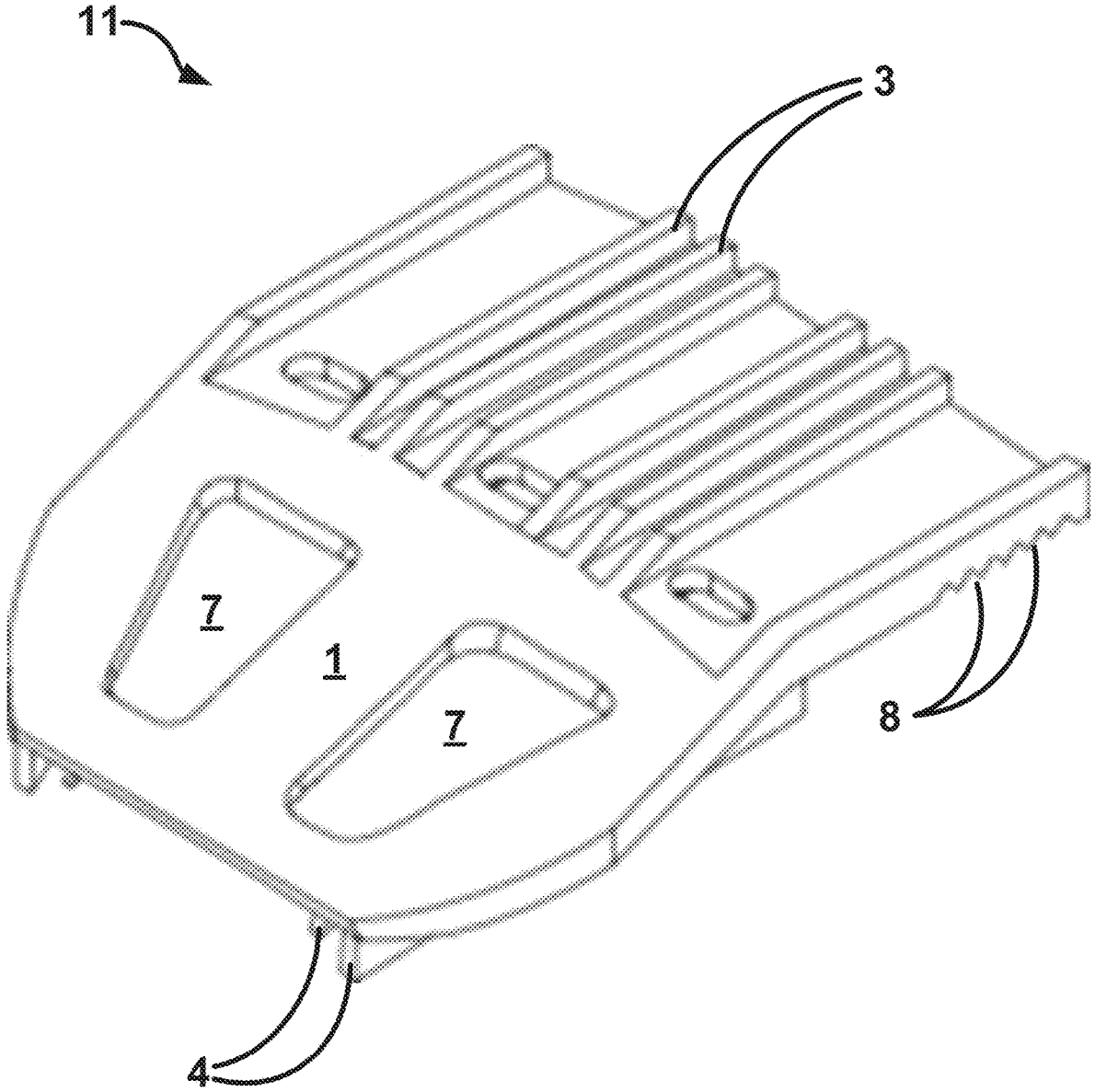
FIG. 6 is a perspective view of another example of the ball scoop of FIG. 1.
Figure 7:
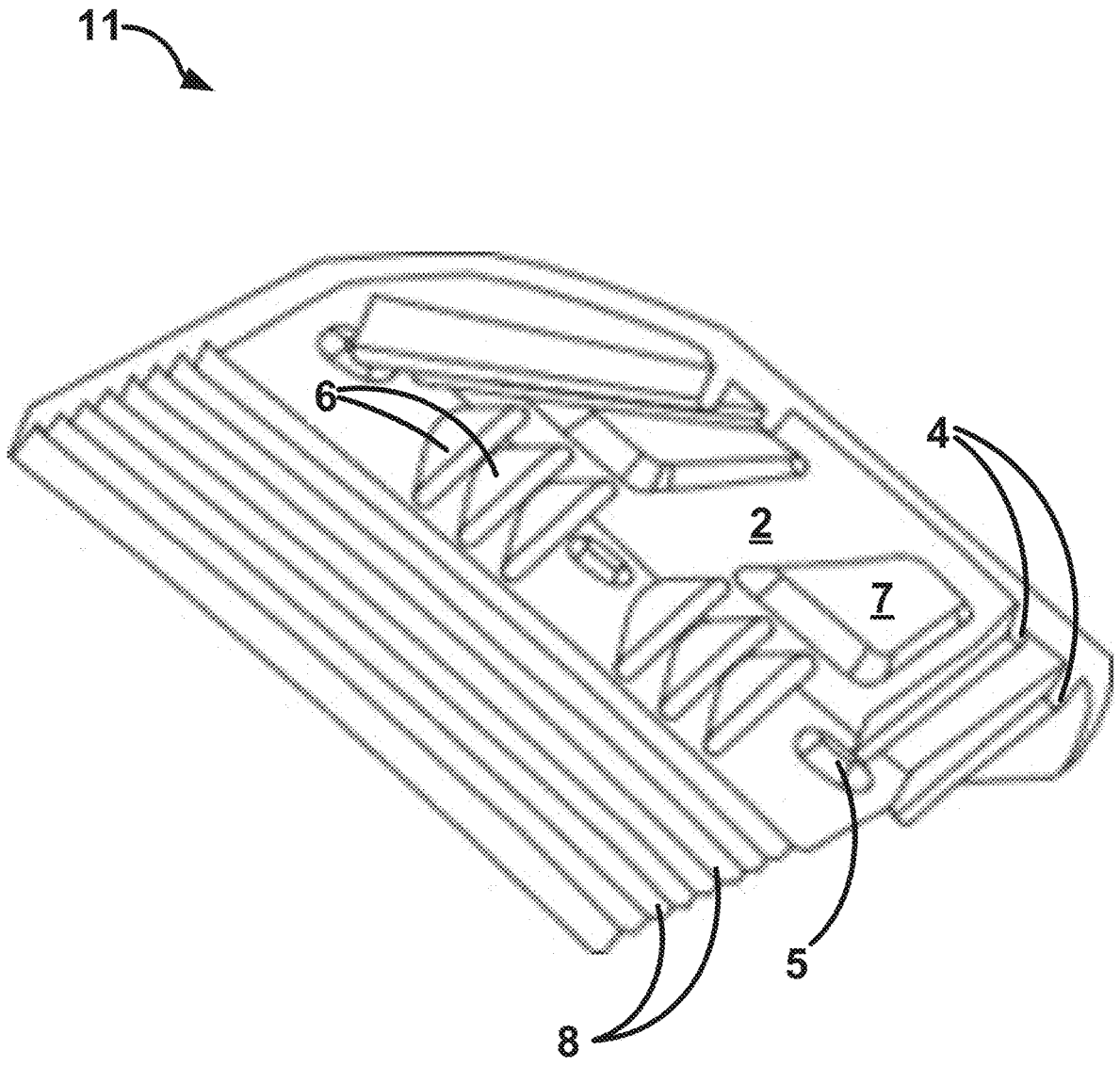
FIG. 7 is another perspective view of the ball scoop of FIGS. 1-6.
Figure 8:
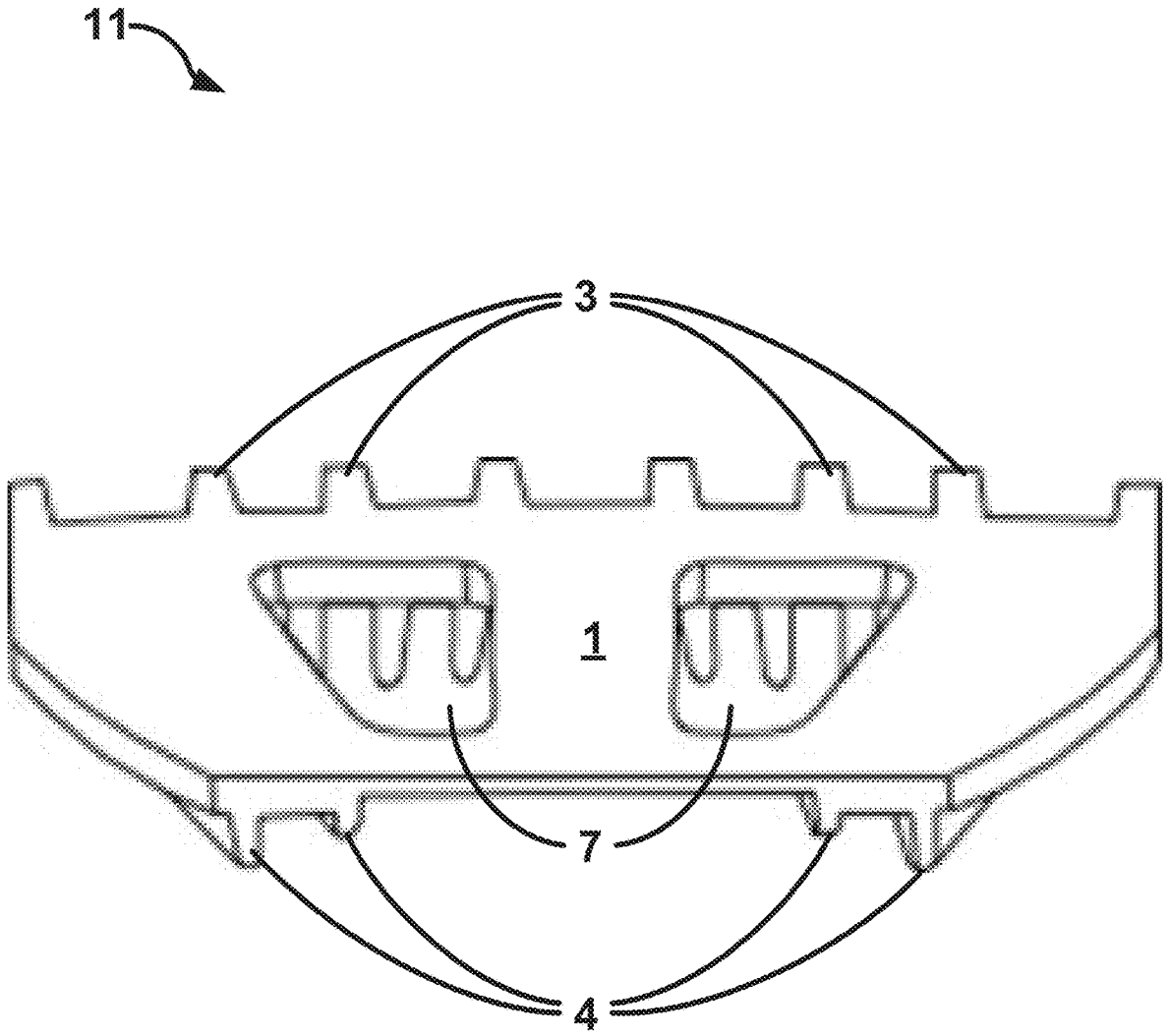
FIG. 8 is a first end view of the ball scoop of FIGS. 1-7.
Figure 9:
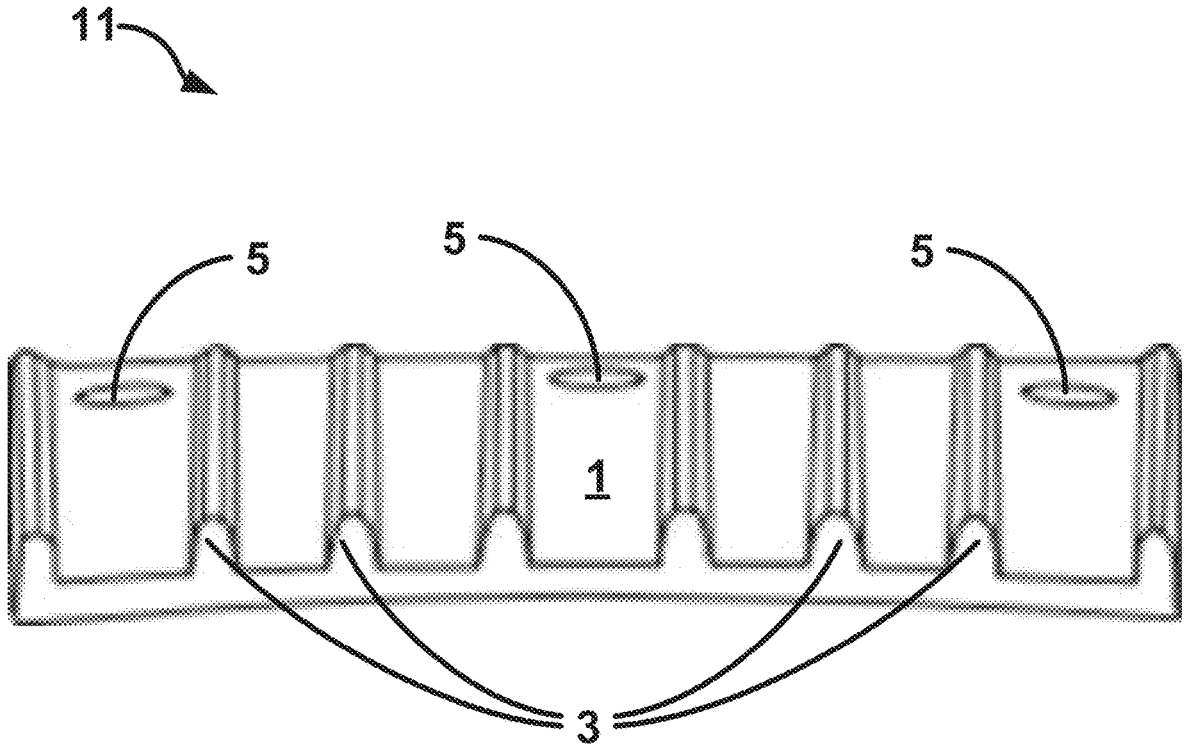
FIG. 9 is a second end view of the ball scoop of FIGS. 1-8.
Figure 10:
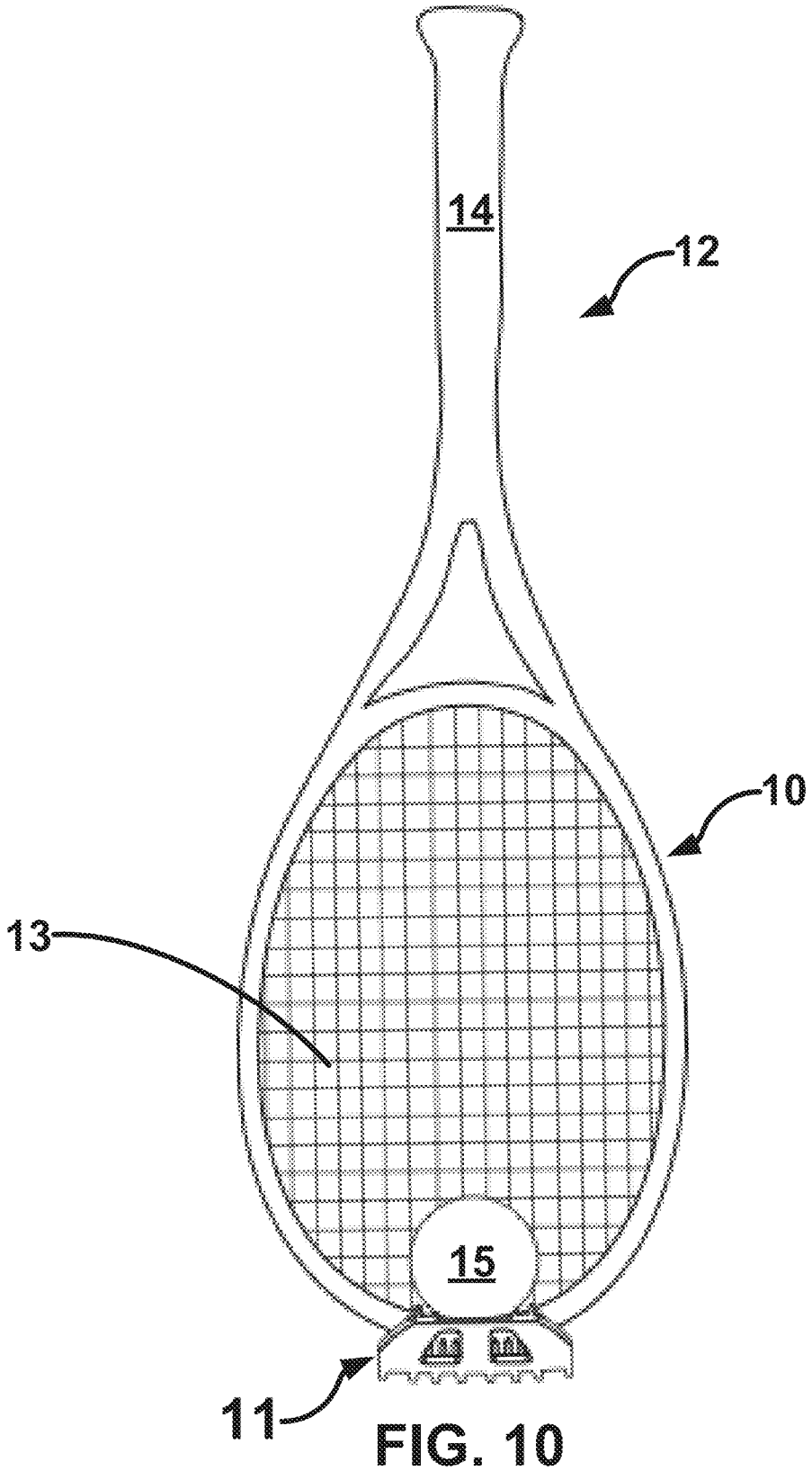
FIG. 10 illustrates the ball scoop of FIGS. 1-9 attached to an example squash-ball racquet and retaining a squash ball.
Figure 11:
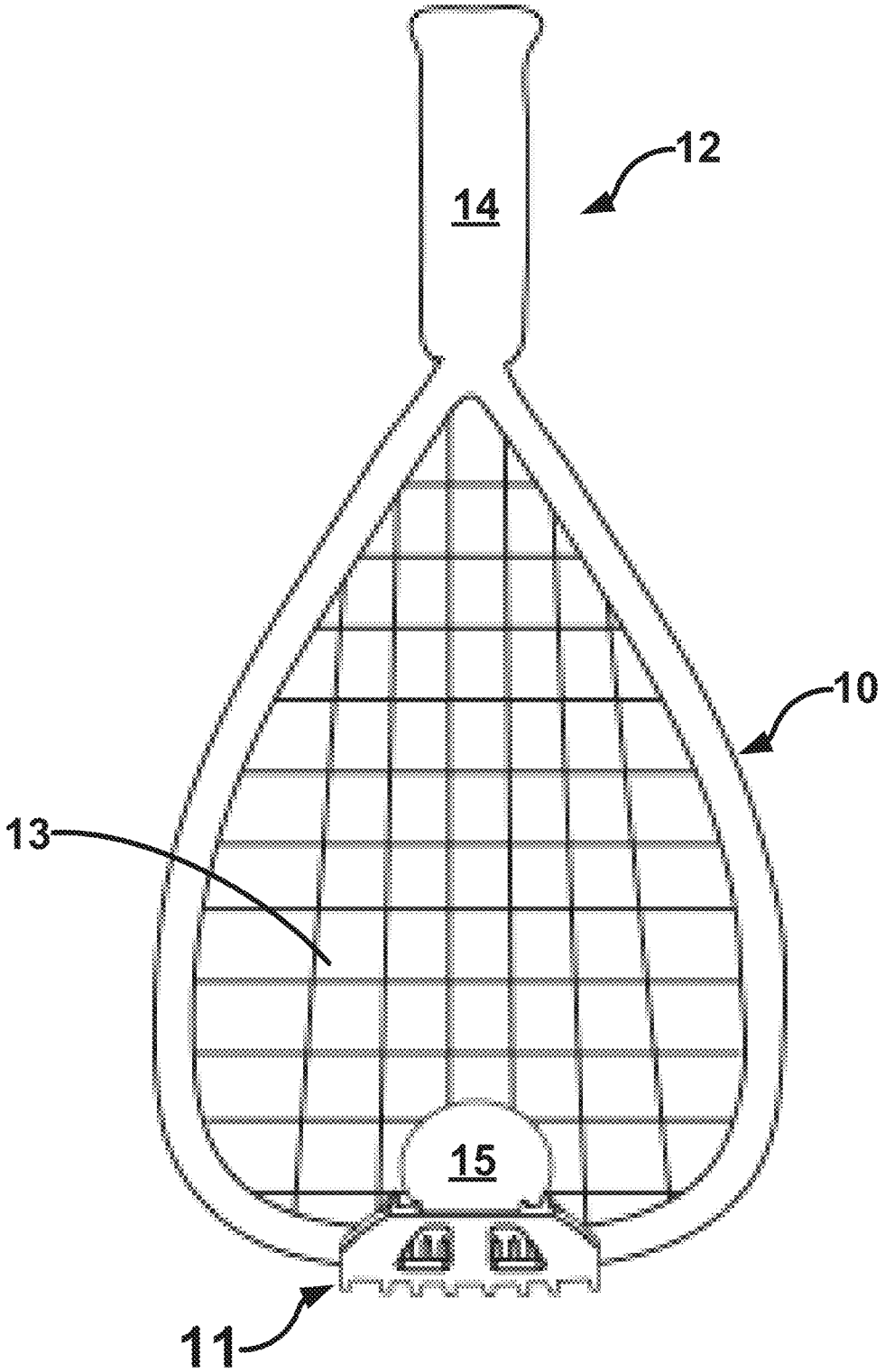
FIG. 11 illustrates the ball scoop of FIGS. 1-9 attached to an example racquetball racquet and retaining a racquetball.
Figure 12:
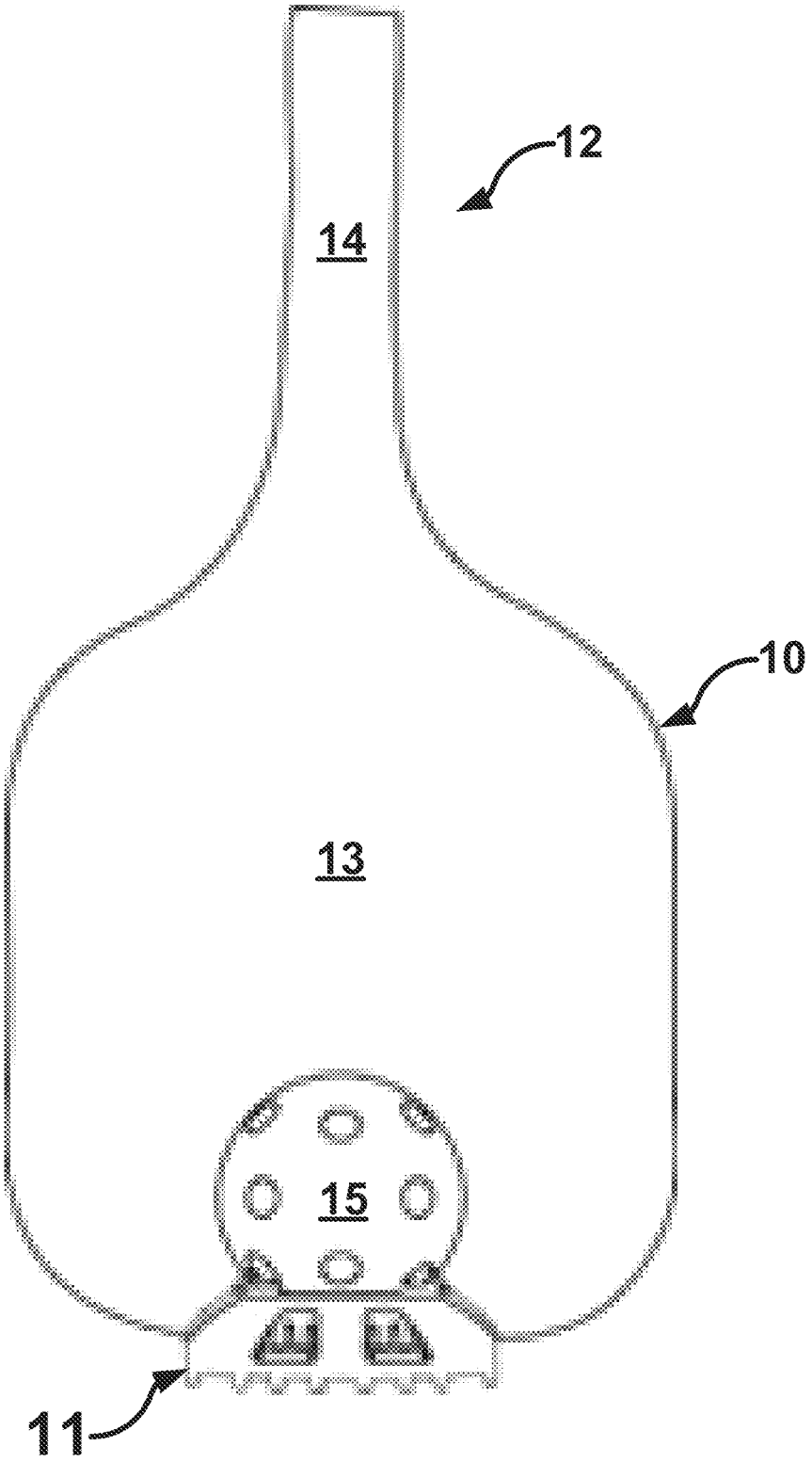
FIG. 12 illustrates the ball scoop of FIGS. 1-9 attached to an example pickleball racquet and retaining a pickleball.
Figure 13:
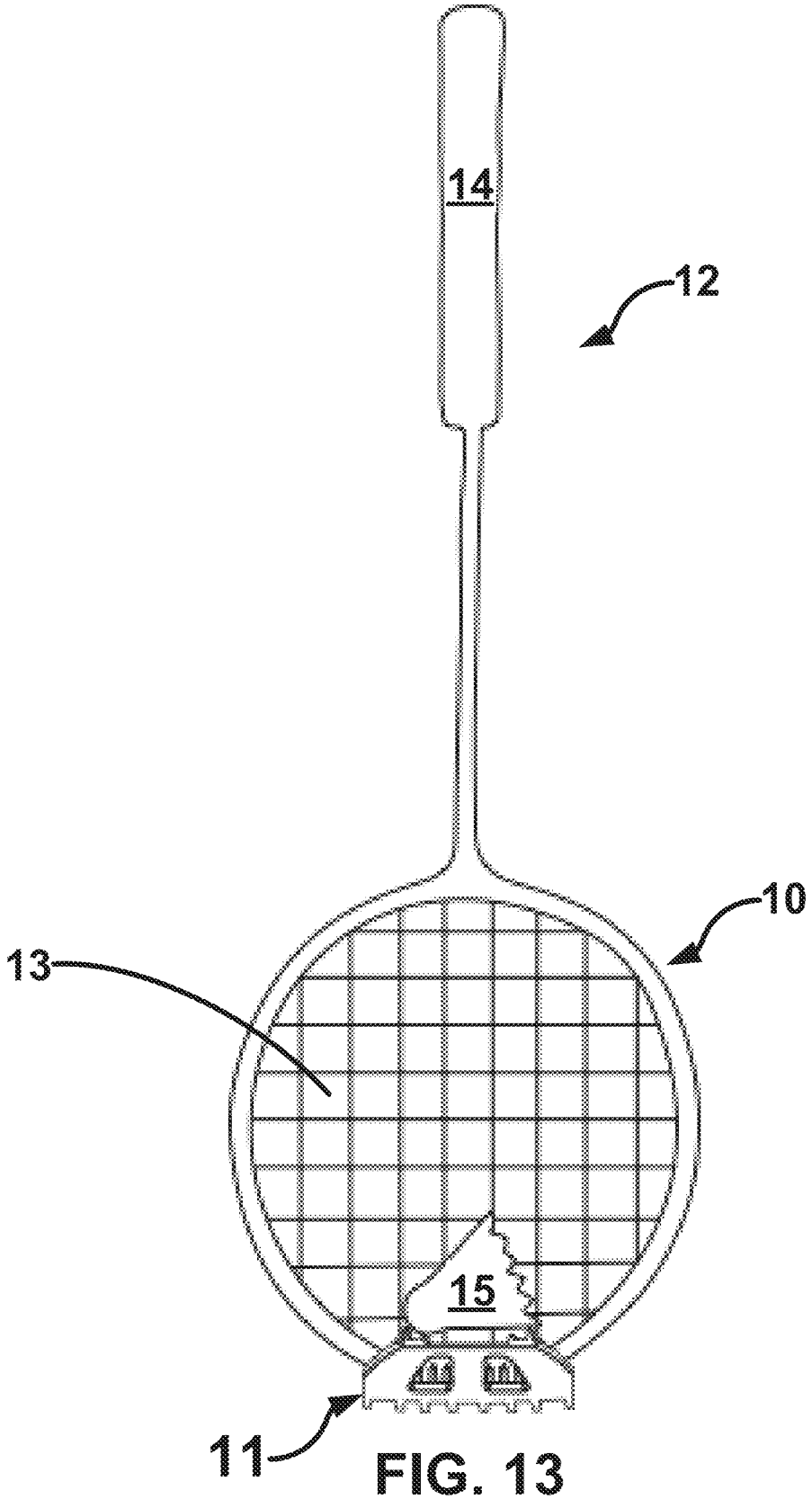
FIG. 13 illustrates the ball scoop of FIGS. 1-9 attached to an example badminton racquet and retaining a badminton birdie.

FIGS. 1-9 depict an example ball scoop 11 of the present invention.

The ball scoop 11 includes the following elements, shown in the drawings:

1) Back Surface
2) Front Surface
3) Wear Ridges
4) Ball-Guide Ridges
5) Mounting Holes
6) Alignment Ridges/Over-Rotation Stop
7) Air-Relief Ports
8) Cut Lines FIGS. 10-13 depict the ball scoop 11 of the invention deployed on various types of athletic racquets.

The ball-pickup racquet scoop 11 (or "scoop 11") works best when attached or molded on the head end 10 of a tennis racket 12, but it can also be attached anywhere around the circumference of the athletic racquet 12. The scoop 11 can either be integrally formed into the metal frame of the racquet 12, or as a standalone unit that attaches to the head 10 of the racquet 12 with wire, string, zip ties 9, etc. It can also be formed onto the bumper of the racquet 12, and would be fastened to the racquet 12 while stringing the racquet 12. When mounted, formed, or attached, the scoop 11 is designed to protrude roughly 80° to 90° away from the face side 13 of the racquet 12. While standing-up straight and holding the handle 14 of the racquet 12, the user slides/pivots the scoop 11 under a ball 15 (e.g., tennis, rubber, synthetic, etc.), which cradles the ball 15 between the scoop's ball guides 4 and the racquet's face 10 to facilitate picking up the ball 15 without ever bending over. Once the ball 15 is cradled, the user can pivot the racquet 12 up to their opposite hand and grab the ball 15, or flip the ball up and hit the ball 15, or let it bounce and then hit the ball 15. This will also eliminate the need to execute trick moves with your feet and the racquet 12, or the "bounce" method to pick up a ball 15. The scoop 11 can be made of a rigid and/or flexible material. Rubber material has worked best because it absorbs the shock that is created when the ball 15 is hit with the racquet 12. This same principle can be used in picking up tennis balls, pickleballs, and badminton birdies. The scoop 11 is useful for picking up a ball 15 on the court as well as picking up a ball 15 while playing with your pet.

1. Overview

A concept of the invention is a flexible (e.g., rubber or other flexible material) piece 11 that is attached to the head 10 of an athletic racquet 12, or formed into the head 10 of an athletic racket racquet 12, or formed into the racquet bumper that provides an easy way to pick up a ball 15 without bending over or physically picking up the ball 15.

The ball scoop 11 could be used as a stand-alone attachment that the user attaches to their racquet 12, or as a feature that is molded into an existing (e.g., new or refurbished) racquet 12 or bumper.

Users of the ball scoop 11 could include dog owners, people having trouble with physical movements, and recreational and/or professional athletes. One would use the ball scoop 11 to aid in retrieving and picking up a ball 15, which could be a tennis ball, racquetball, pickleball, rubber ball, plastic ball, badminton birdie, etc.

2. Details

A rubber, plastic, or metal material that the scoop 11 is made out of can be molded into a racquet 12. Studies have found that rubber absorbs the shock when the ball 15 comes into contact with the racquet 12.

Wear ridges 3 protect the means by which the scoop 11 is attached to a racquet 12 (i.e., if not molded into a racquet 12). For instance, if zip ties 9 or wire are used to attach a standalone scoop 11, the wear ridges 3 will make frictional contact with the ground and wear down slowly instead of wearing down the attachment mechanism (e.g., zip tie 9, wire, racquet string, string, rope, etc.). The wear ridges 3 protrude above the fastening device to protect them from wear (similar to the role of tire treads).

Alignment ridges 6 aid in correctly mounting and/or stabilizing the scoop 11 when formed as a standalone attachment instead of molded integrally with the racquet.

Figure 14:
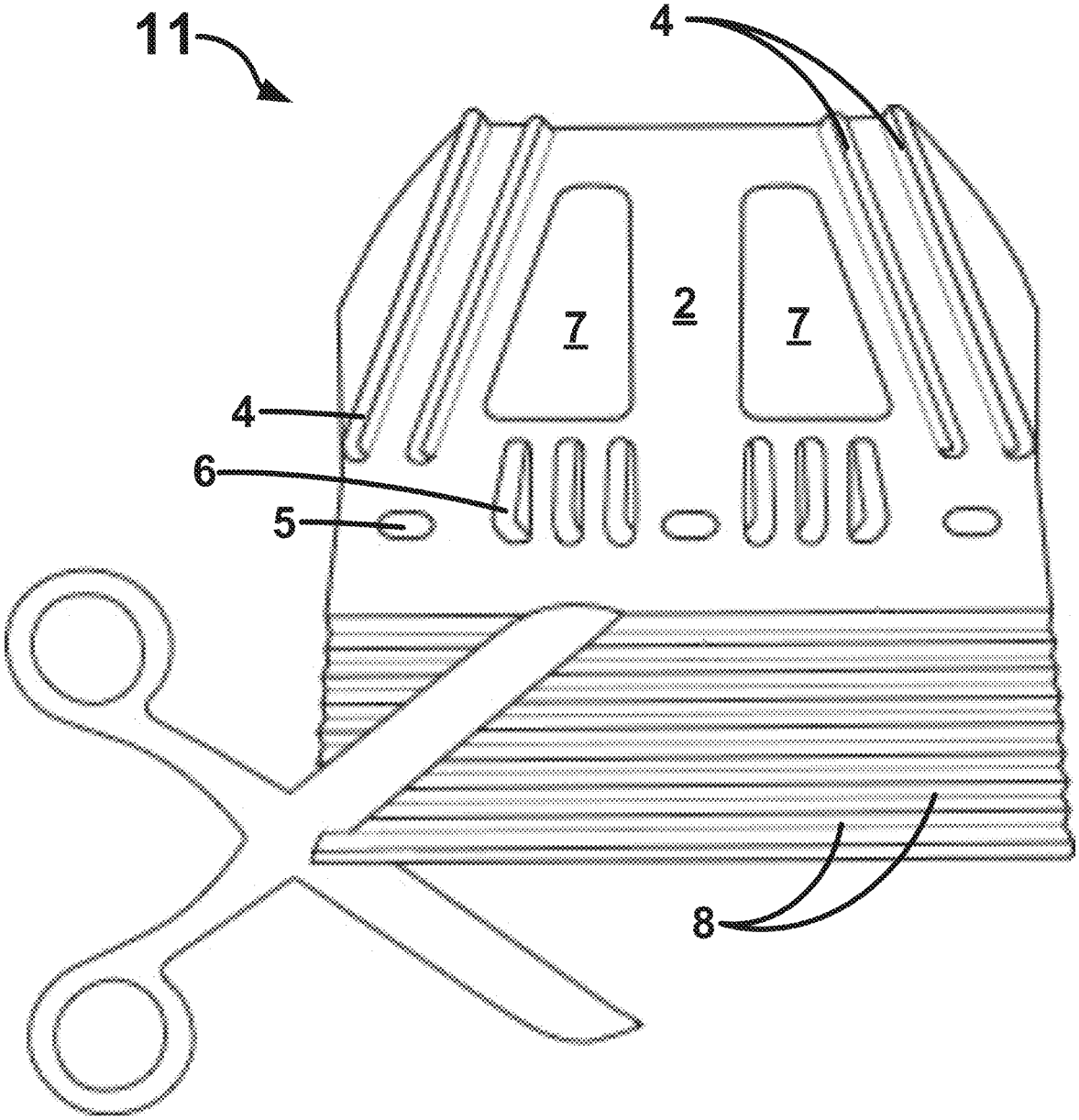
FIG. 14 is a conceptual diagram illustrating a technique for resizing the ball scoop of FIGS. 1-9 by trimming a proximal edge thereof.
Figure 15:
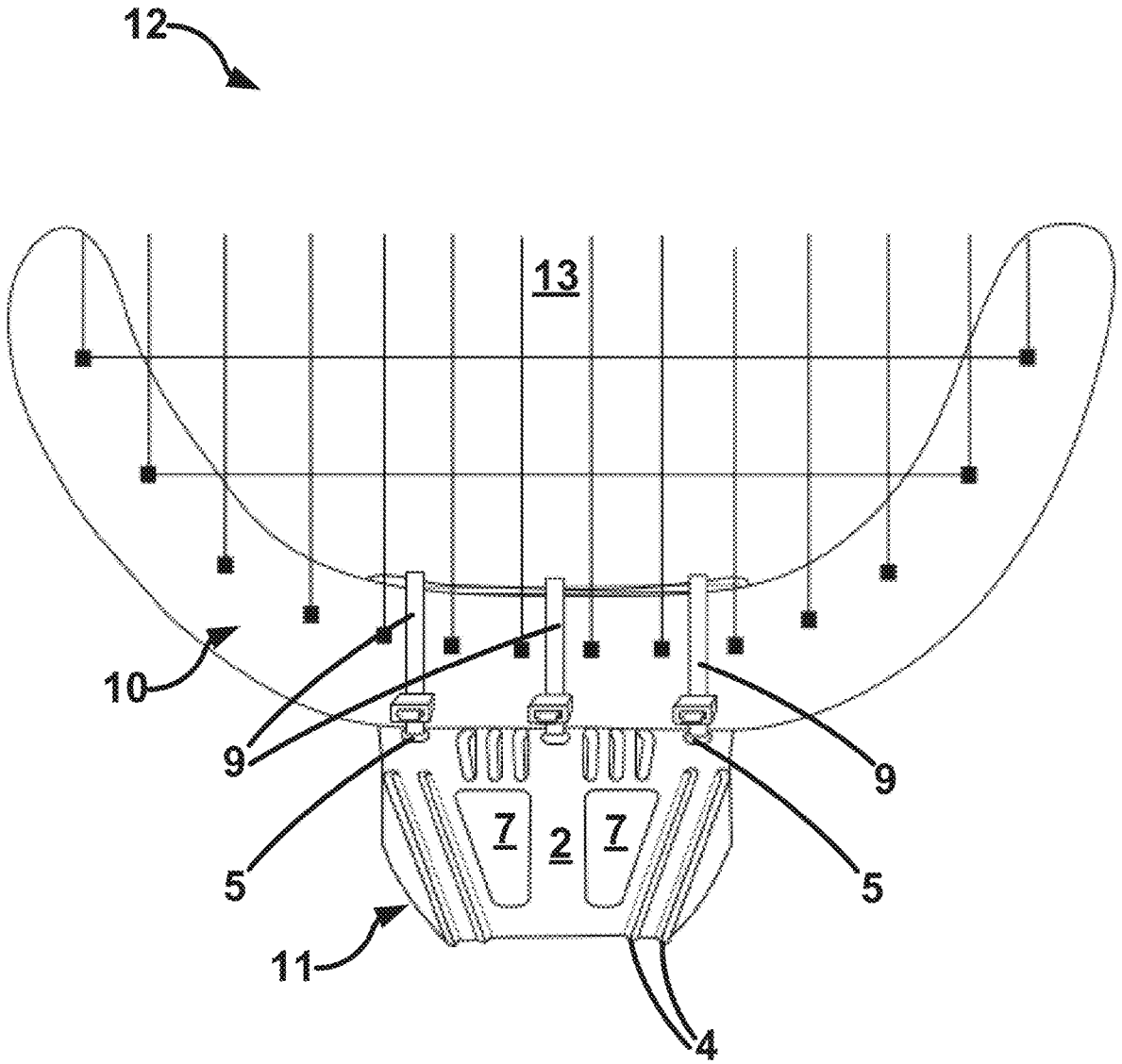
FIG. 15 shows a front view of the ball scoop of FIGS. 1-9 secured to a tennis racquet via an example zip-tie connection.
Figure 16:
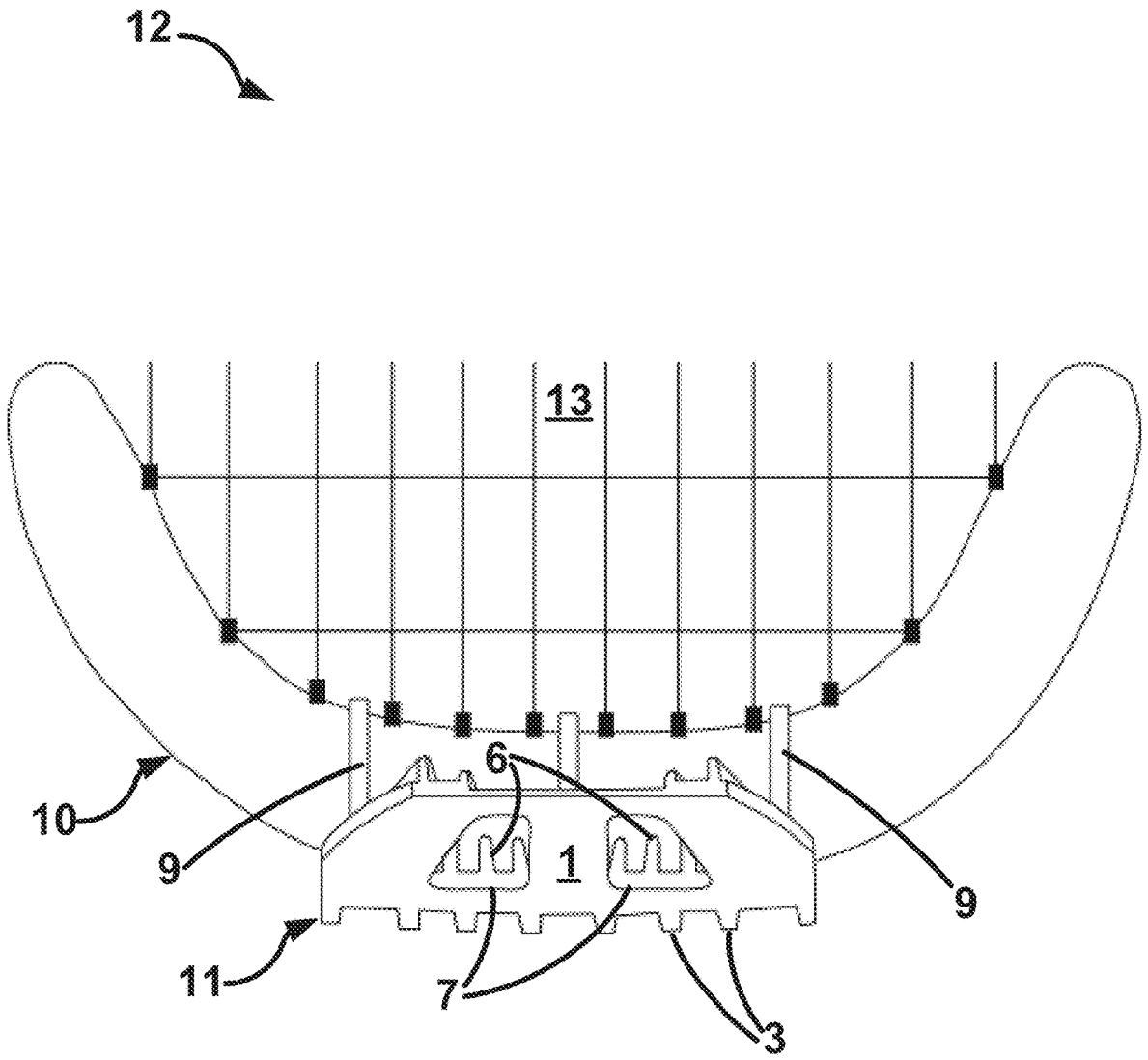
FIG. 16 shows the zip-tie connection of FIG. 15 from an end perspective of the ball scoop.
Figure 17:
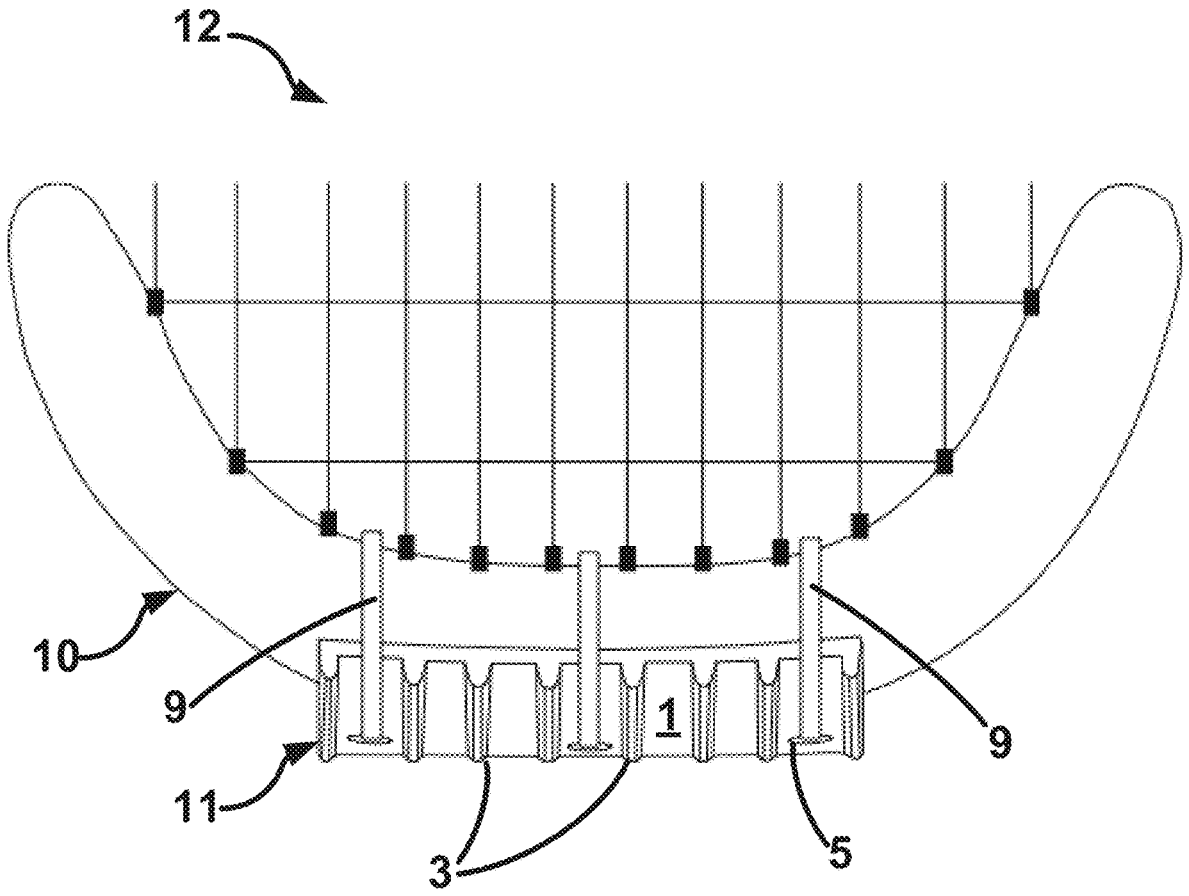
FIG. 17 shows the zip-tie connection of FIGS. 15 and 16 from a bottom perspective of the ball scoop.
Figure 18:
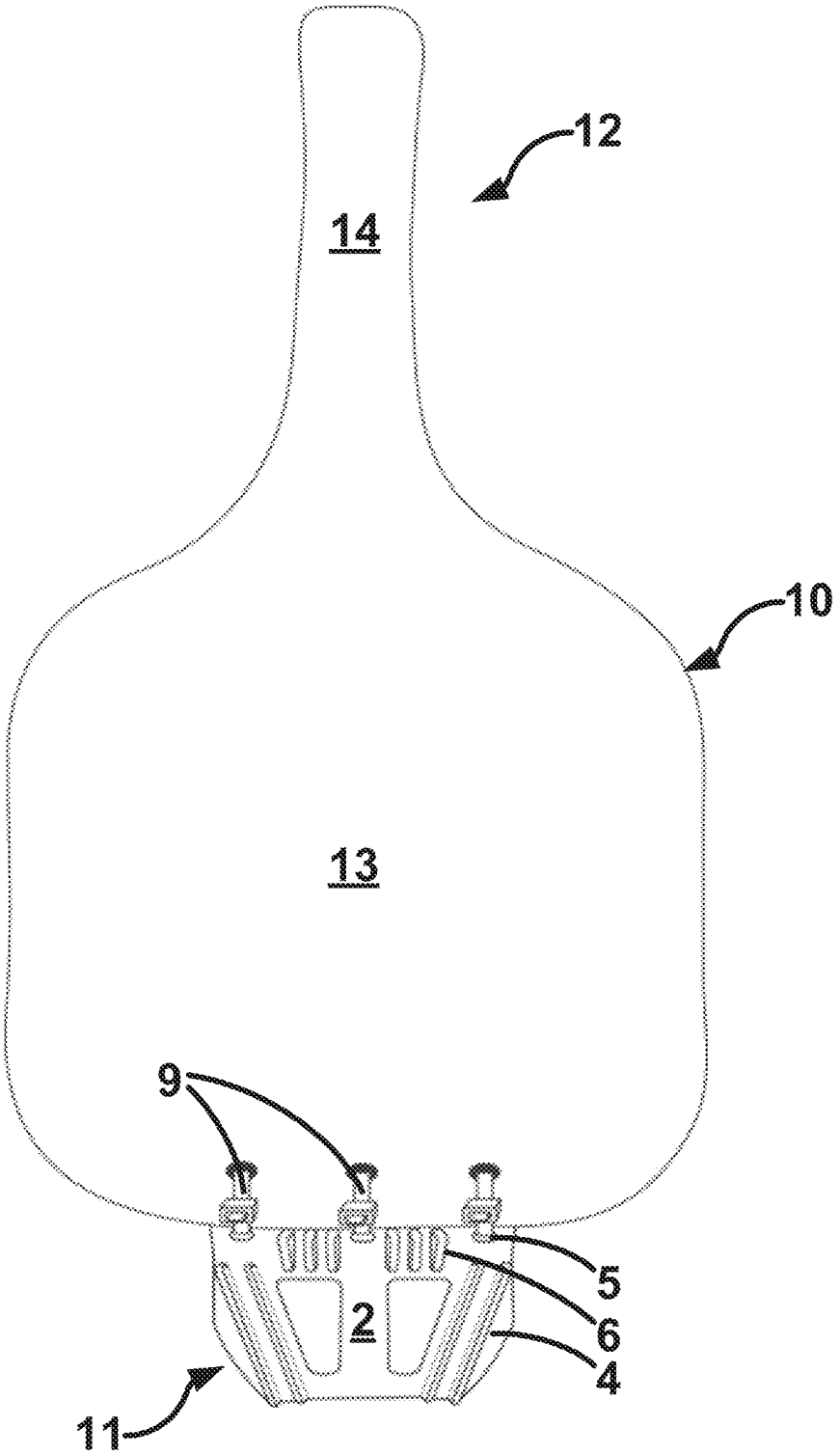
FIG. 18 shows another example zip-tie connection between the ball scoop and a pickleball racquet from a front perspective of the ball scoop.
Figure 19:
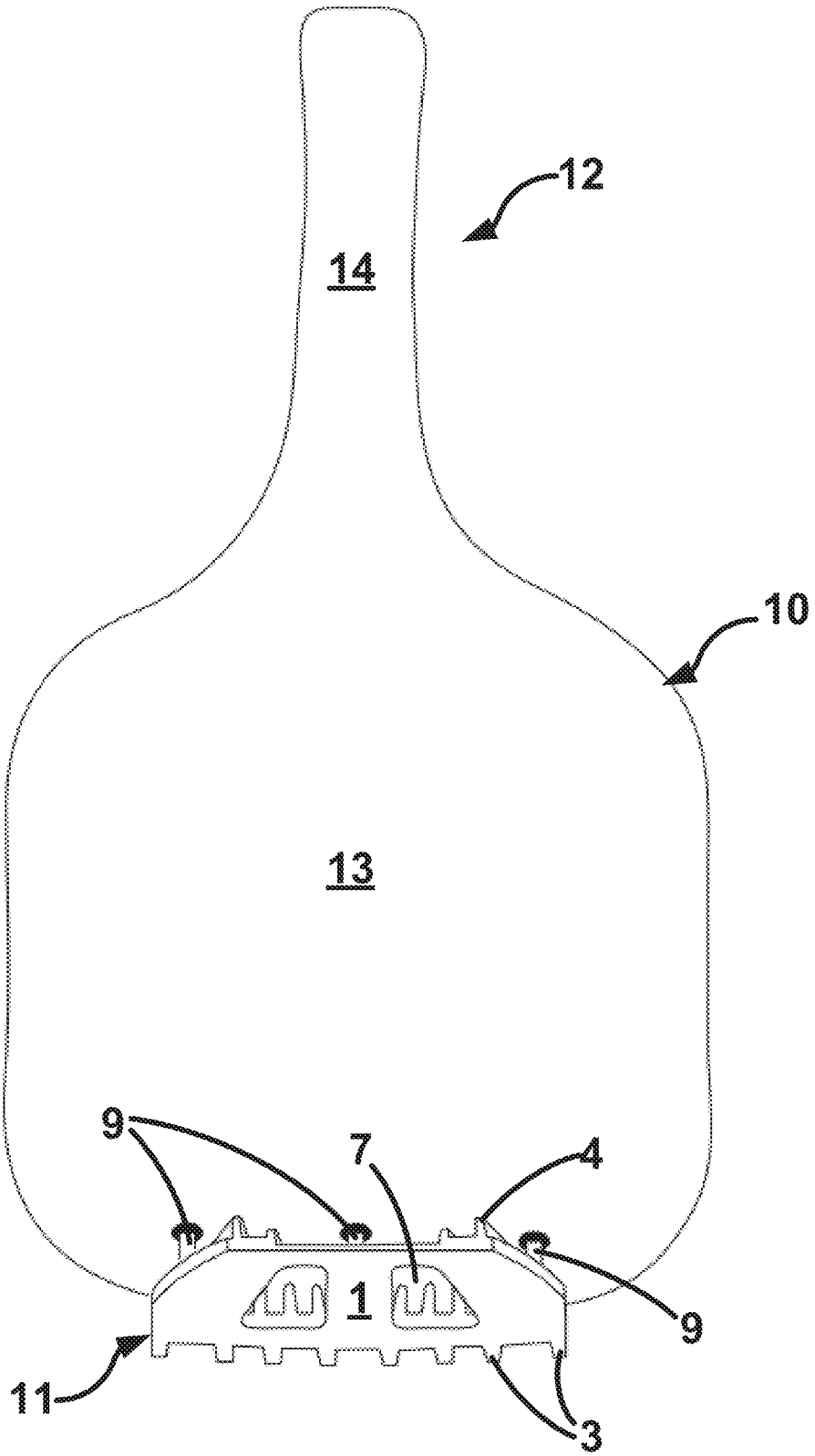
FIG. 19 shows the zip-tie connection of FIG. 18 from an end perspective of the ball scoop.
Figure 20:
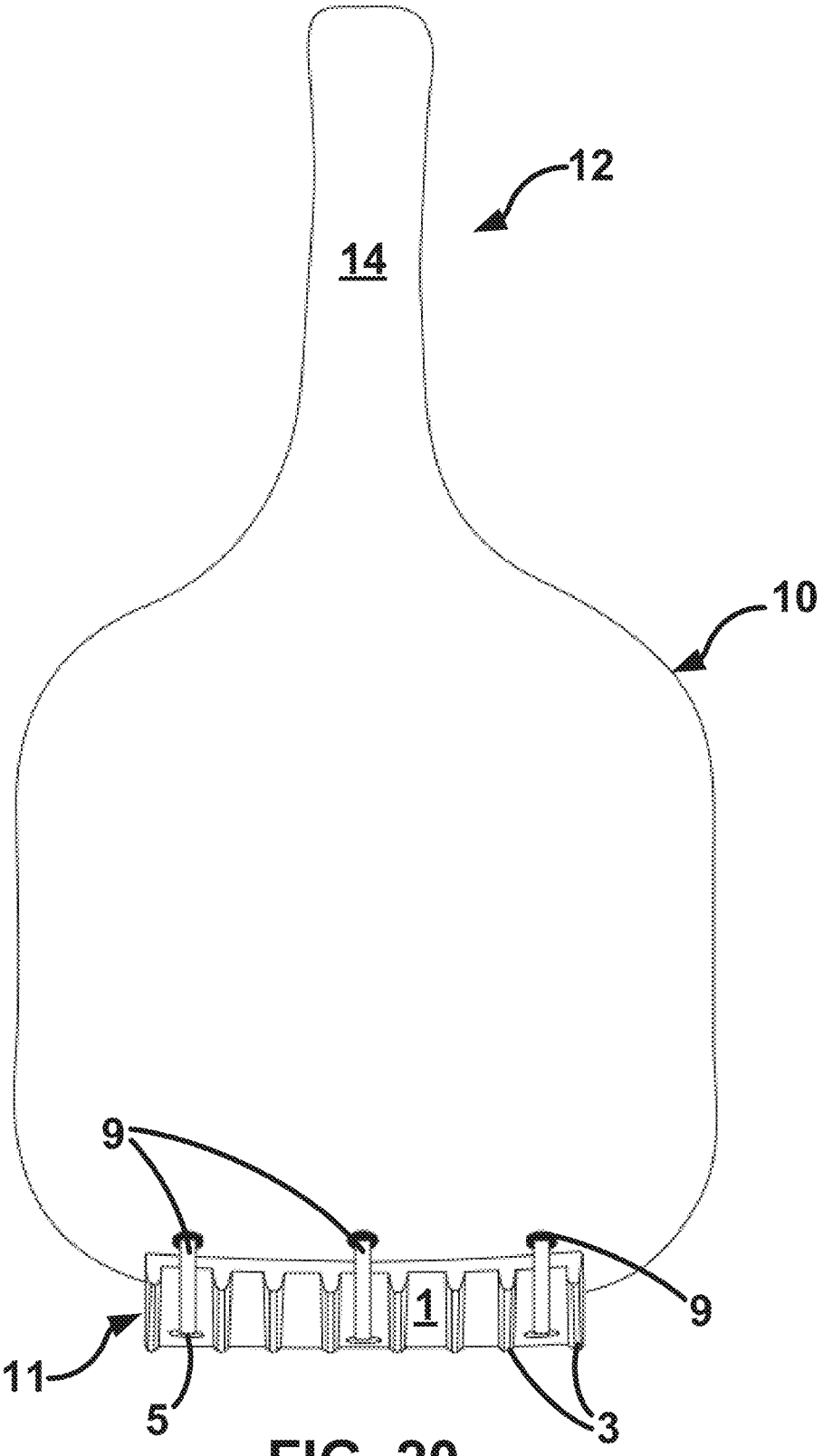
FIG. 20 shows the zip-tie connection of FIGS. 18 and 19 from a bottom perspective of the ball scoop.

Referring to FIG. 14, cut lines 8 (e.g., linear perforations) allow the user to trim the scoop 11 to the appropriate width for a specific athletic racquet 12.

The scoop 11 (if used as a standalone attachment or molded into a racquet 12) could be oriented anywhere around the circumference of the athletic-racquet head 10. There are two pairs of raised ball guides 4 that assist with picking up, cradling, and holding the ball 15 in the scoop 11. Ball guides 4 are believed to improve the usability of the scoop 11.

When the scoop 11 is installed (whether as a standalone attachment or molded into a racquet 12) there is a roughly 5° pivot/bend that increases the performance of the product over one that doesn't have this pivot/bend. The pivot or bend is slightly toward the face 13 of the racquet 12.

Referring to FIGS. 15-20, a recommended attachment method for the standalone scoop 11 is zip ties 9. However, the scoop 11 is designed to accommodate various means of attachment (e.g., wire, string, etc.). The molded-in-racquet version of the scoop 11 would not need to be attached, as it is molded into the racquet 12 itself or into its bumper.

Air-relief ports 7 allow the air that is being trapped and pushed in the scoop's bowl 2 to escape when trying to hit the ball 15 with the scoop-side face 13 of the racquet 12.

The color of the scoop 11 (whether a standalone attachment or molded into a racquet 12) can be customized to whatever the user orders for their product.

The back surface 1 and/or front surface 2 of the scoop 11 can be customized with various logos, organization and/or business brands, schools, names, etc. This includes printing directly on the scoop 11, adding material to the scoop 11 or etching material from the scoop 11 to recreate a raised emblem/logo/brand, or any other means of creating a personalized Scoop product.

Although the ball scoop 11 is described in terms of vertical, horizontal, transverse (lateral), longitudinal, and the like, it should be understood that variations from the absolute vertical, horizontal, transverse, and longitudinal are also within the scope of the present invention.

Although the ball scoop 11 has primarily been described in connection with tennis, it can readily be appreciated that it is not limited solely to such field, and can be used in other fields including, but not limited to, dog walking. For example, the apparatus/method can be used to pick up a ball 15 returned by a dog during a game of fetch.

The embodiments above are chosen, described, and illustrated so that persons skilled in the art will be able to understand the invention and the manner and process of making and using it. The descriptions and the accompanying drawings should be interpreted in the illustrative and not the exhaustive or limited sense. The invention is not intended to be limited to the exact forms disclosed. While the description endeavors to disclose all of the embodiments of the invention that are reasonably foreseeable, there may be unforeseeable insubstantial modifications that remain as equivalents. It should be understood by persons skilled in the art that there may be other embodiments than those disclosed that fall within the scope of the invention as defined by the claims. Where a claim limitation, if any, is expressed as a "means for" or "step for" performing a specified function, it is intended that such claim limitation be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A ball scoop adapted to couple to a racquet, the ball scoop comprising:

a body comprising:

a front surface;

a back surface;

a generally planar racquet-engagement member; and a generally planar scoop member extending distally at an angle from the racquet-engagement member;

a pair of non-parallel ball-guide ridges disposed on the scoop member on the front surface and mutually angled to diverge from one another along a distal-to-proximal direction toward the racquet engagement member;

at least one wear ridge disposed on the racquet-engagement member on the back surface; and at least one mounting aperture located adjacent said at least one wear ridge configured to receive respective fixation members to couple the ball scoop to the racquet.

2. The ball scoop of claim 1, wherein the at least one wear ridge comprises a pair of wear ridges disposed on opposite sides of each of the plurality of apertures.

3. The ball scoop of claim 1, wherein the fixation members comprise zip ties, and wherein the plurality of apertures are sized to receive the zip ties.

4. The ball scoop of claim 1, wherein the front surface defines a plurality of alignment ridges configured to contact an outer-most edge of the racquet.

5. The ball scoop of claim 1, wherein the body defines a pair of air-relief ports extending from the front surface to the back surface.

6. The ball scoop of claim 1, wherein the racquet-engagement member comprises a plurality of parallel cut lines for resizing the ball scoop to conform to a frame width of the racquet.

7. The ball scoop of claim 1, wherein the ball scoop is formed from a rubber material.

8. A system comprising:

an athletic racquet; and a ball scoop disposed on a frame of the athletic racquet, the ball scoop comprising:

a front surface;

a back surface;

a generally planar racquet-engagement member; and a generally planar scoop member extending distally at an angle from the racquet-engagement member;

a pair of non-parallel ball-guide ridges disposed on the scoop member on the front surface and mutually angled to diverge from one another along a distal-to-proximal direction toward the racquet engagement member;

at least one wear ridge disposed on the racquet-engagement member on the back surface; and at least one mounting aperture located adjacent said at least one wear ridge configured to receive respective fixation members to couple the ball scoop to the racquet.

9. The system of claim 8, wherein the ball scoop is integrally formed with the frame of the athletic racquet.

10. The system of claim 8, further comprising a plurality of fixation members securing the ball scoop to the frame of the athletic racquet.

11. The system of claim 10, wherein the fixation members comprise zip ties.

12. The system of claim 10, wherein the at least one wear ridge comprises a pair of wear ridges disposed on opposite sides of each of the plurality of fixation members to protect the plurality of fixation members from frictional contact with a ground surface.

* * * * *